US009824633B2

(12) United States Patent
Qing et al.

(10) Patent No.: US 9,824,633 B2
(45) Date of Patent: Nov. 21, 2017

(54) PIXEL DRIVING CIRCUIT AND METHOD FOR DRIVING THE SAME

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Haigang Qing, Beijing (CN); Xiaojing Qi, Beijing (CN)

(73) Assignees: BOE TECHNOLOGY GROUP CO., LTD., Beijing (CN); Chengdu BOE Optoelectronics Technology Co., Ltd., Beijing (CN)

( * ) Notice: Subject to any disclaimer, the term of this patent is extended or adjusted under 35 U.S.C. 154(b) by 0 days.

(21) Appl. No.: 14/912,522

(22) PCT Filed: Jul. 29, 2015

(86) PCT No.: PCT/CN2015/085395
§ 371 (c)(1),
(2) Date: Feb. 17, 2016

(87) PCT Pub. No.: WO2016/123937
PCT Pub. Date: Aug. 11, 2016

(65) Prior Publication Data

US 2016/0351123 A1 Dec. 1, 2016

(30) Foreign Application Priority Data

Feb. 2, 2015 (CN) ..... 2015 1 0053217

(51) Int. Cl.
*G09G 3/32* (2016.01)
*G09G 3/3241* (2016.01)
(Continued)

(52) U.S. Cl.
CPC ..... *G09G 3/3241* (2013.01); *G09G 3/3233* (2013.01); *G09G 3/3258* (2013.01);
(Continued)

(58) Field of Classification Search
None
See application file for complete search history.

(56) References Cited

U.S. PATENT DOCUMENTS

2010/0073266 A1 3/2010 Na et al.
2013/0113690 A1 5/2013 Ishii et al.
2016/0189606 A1* 6/2016 Chen ..... G09G 3/3233 345/214

FOREIGN PATENT DOCUMENTS

CN 1776794 A 5/2006
CN 102222465 A 10/2011
(Continued)

OTHER PUBLICATIONS

Second Chinese Office Action, for Chinese Patent Application No. 2015100532173, dated Dec. 16, 2016, 12 pages.
(Continued)

*Primary Examiner* — Joseph Haley
(74) *Attorney, Agent, or Firm* — Kinney & Lange P.C.

(57) ABSTRACT

The present disclosure provides a pixel driving circuit and a method for driving the same. The pixel driving circuit comprises: a data signal input unit configured to provide a data voltage; a light emitting unit configured to emit light and display; a light emitting control unit configured to control the light emission of the light emitting unit at a pixel driving display phase; a reference voltage providing unit configured to provide a reference voltage; a driving unit configured to receive the reference voltage provided by the reference voltage providing unit and drive the light emitting unit via the light emitting control unit at the pixel driving display phase; and a threshold voltage compensating unit
(Continued)

configured to receive the data voltage via the data signal input unit at an initialization phase, and to store the data voltage and the threshold voltage of the driving unit at an threshold voltage compensating phase, such that the voltage provided to the gate of the driving unit at the pixel driving display phase is able to compensate the threshold voltage of the driving unit and accurately control the driving current of the driving unit.

20 Claims, 5 Drawing Sheets

(51) Int. Cl.
*G09G 3/3258* (2016.01)
*G09G 3/3275* (2016.01)
*G09G 3/3233* (2016.01)

(52) U.S. Cl.
CPC ... *G09G 3/3275* (2013.01); *G09G 2300/0426* (2013.01); *G09G 2300/0819* (2013.01); *G09G 2300/0861* (2013.01); *G09G 2310/0251* (2013.01); *G09G 2310/0262* (2013.01); *G09G 2320/0233* (2013.01); *G09G 2320/043* (2013.01); *G09G 2320/0626* (2013.01)

(56) References Cited

FOREIGN PATENT DOCUMENTS

| | | | |
|---|---|---|---|
| CN | 102280085 | A | 12/2011 |
| CN | 103000127 | A | 3/2013 |
| CN | 103198793 | A | 7/2013 |
| CN | 203134328 | U | 8/2013 |
| CN | 103839520 | A | 6/2014 |
| CN | 203733448 | U | 7/2014 |
| CN | 104575392 | A | 4/2015 |
| JP | 2004287376 | A | 10/2004 |

OTHER PUBLICATIONS

First Chinese Office Action, for chinese Patent Application No. 2015100532173, dated Jul. 4, 2016, 12 pages.

International Search Report and Written Opinion (including English translation) dated Oct. 21, 2015, for corresponding PCT Application No. PCT/CN2015/085395.

* cited by examiner

PIXEL DRIVING CIRCUIT AND METHOD FOR DRIVING THE SAME

CROSS-REFERENCE TO RELATED APPLICATION(S)

This application is a U.S. National Phase Application of International Application No. PCT/CN2015/085395, filed on Jul. 29, 2015, entitled "PIXEL DRIVING CIRCUIT AND METHOD FOR DRIVING THE SAME," which claims priority to Chinese Application No. 201510053217.3, filed on Feb. 2, 2015, both of which are incorporated herein by reference in their entirety.

TECHNICAL FIELD

The present disclosure relates to the field of display, and in particular, to a pixel driving circuit and a method for driving the same.

BACKGROUND

An AMOLED (Active Matrix Organic Light Emitting Diode) display is widely used because of its wide viewing angle, high color contrast, fast response speed, and low cost. The reason why AMOLED is capable of emitting light is that it is driven by a current generated by a driving Thin Film Transistor (TFT) when being saturated. No matter which one of an LTPS (Low Temperature PolySilicon) process or an oxide process is used, due to the non-uniformity of the process, the backplane of a thin film transistor has a poor uniformity in terms of the threshold voltage (Vth) for the driving Thin Film Transistor at different positions during the process, and Vth also drifts, both of which are threats to the consistency for a current-driven device. Because different threshold voltages may lead to different driving current when a same gray-scale voltage is input, the resulting currents are not consistent. A conventional AMOLET driving circuit comprises two thin film transistors and one storage capacitor (or simply, 2T1C), and such a circuit always has a poor uniformity in luminance. FIG. 1 shows a block diagram of a 2T1C circuit, and FIG. 2 shows operation timing diagram of this 2T1C circuit.

SUMMARY

The present disclosure provides a pixel driving circuit and a method for driving the same to address the problem in the prior art that, due to the difference in the threshold voltages of the driving transistors, currents flowing through different organic light emitting diodes are non-uniform when a same data voltage is received, resulting a non-uniform display on the whole panel.

To address the above problem, the present disclosure provides a pixel driving circuit, comprising:

a data signal input unit configured to receive a data signal and provide a data voltage;

a light emitting unit configured to emit light and display;

a light emitting control unit configured to control the light emission of the light emitting unit at a pixel driving display phase;

a reference voltage providing unit configured to provide a reference voltage;

a driving unit configured to receive the reference voltage provided by the reference voltage providing unit and drive the light emitting unit via the light emitting control unit at the pixel driving display phase; and a threshold voltage compensating unit configured to receive the data voltage via the data signal input unit at an initialization phase, and to store the data voltage and the threshold voltage of the driving unit at an threshold voltage compensating phase, such that the voltage provided to the gate of the driving unit at the pixel driving display phase is able to compensate the threshold voltage of the driving unit and accurately control the driving current of the driving unit, wherein the data signal input unit is connected to a data signal terminal, a first control signal terminal, and the threshold voltage compensating unit, wherein the light emitting unit is connected to the light emitting control unit and a high voltage terminal, wherein the light emitting control unit is connected to the light emitting unit, the driving unit, the threshold voltage compensating unit, a second control signal terminal, a third control signal terminal, and a low voltage terminal, wherein the reference voltage providing unit is connected to the driving unit, a reference voltage terminal, and the first control signal terminal, wherein the driving unit is connected to the light emitting control unit, the reference voltage providing unit, and the threshold voltage compensating unit, and wherein the threshold voltage compensating unit is connected to the data signal input unit, the light emitting control unit, the driving unit, and the first control signal terminal.

Preferably, the light emitting unit comprises an organic light emitting diode for emitting light, the organic light emitting diode having a first electrode connected to the light emitting control unit and a second electrode connected to the high voltage terminal.

Preferably, the data signal input unit comprises a first transistor, the first transistor having a gate connected to the first control signal terminal, a first electrode connected to the data signal terminal, and a second electrode connected to the threshold voltage compensating unit.

Preferably, the driving unit comprises a driving transistor, the driving transistor having a gate connected to the threshold voltage compensating unit, a first electrode connected to the light emitting control unit, and a second electrode connected to the reference voltage providing unit, and being configured to provide the light emitting unit via the light emitting control unit with a constant driving current independent of the threshold voltage.

Preferably, the light emitting control unit comprises a second transistor, a fourth transistor, and a fifth transistor, wherein the second transistor has a gate connected to the second control signal terminal, a first electrode connected to the second electrode of the first transistor, and a second electrode connected to the second electrode of the driving transistor, wherein the fourth transistor has a gate connected to the second control signal terminal, a first electrode connected to the second electrode of the driving transistor, and a second electrode connected to the light emitting unit, and wherein the fifth transistor has a gate connected to the third control signal terminal, a first electrode connected to the first electrode of the driving transistor, and a second electrode connected to the low voltage terminal.

Preferably, the threshold voltage compensating unit comprises a first capacitor and a third transistor, wherein the first capacitor has a first terminal connected to the second electrode of the first transistor and a second terminal connected to the gate of the driving transistor, and wherein the third transistor has a gate connected to the first control signal terminal, a first electrode connected to the first electrode of the driving transistor, and a second electrode connected to the second terminal of the first capacitor.

Preferably, the reference voltage providing unit comprises a sixth transistor, the sixth transistor having a gate connected to the first control signal terminal, a first electrode connected to a reference voltage terminal, and a second electrode connected to the second electrode of the driving transistor, wherein the reference voltage providing unit provides, under the control of the first control signal, the driving transistor with the reference voltage, such that, when the driving transistor is connected in a form of diode, the gate of the driving transistor is charged by the reference voltage via the driving transistor such that the voltage at the gate of the driving transistor is equal to the difference between the reference voltage and the threshold voltage of the driving transistor.

Preferably, the data signal input unit writes the data voltage into the first capacitor under the control of the first control signal, such that the voltage across the first capacitor is equal to the data voltage minus the difference between the reference voltage and the threshold voltage of the driving transistor.

Preferably, the first transistor, the second transistor, the third transistor, the fourth transistor, the fifth transistor, the sixth transistor, and the driving transistor are P-type thin film transistors or N-type thin film transistors.

The present disclosure further provides a method for driving the above pixel driving circuit, comprising:

an initialization step of initializing a gate of a driving unit to prepare for writing a reference voltage;

a threshold voltage compensating step of writing a data voltage into a threshold voltage compensating unit while a reference voltage is written into the threshold voltage compensating unit via the driving unit, such that the voltage provided by the threshold voltage compensating unit to the gate of the driving unit is able to compensate the threshold voltage of the driving unit and the driving current of the driving unit is controlled accurately; and a pixel driving display step of driving a light emitting unit to emit light via a light emitting control unit.

Preferably, the initialization step comprises: controlling the first transistor, the third transistor, the fifth transistor, and the sixth transistor to be turned on, and controlling the second transistor and the fourth transistor to be turned off, such that the driving transistor is connected in a form of diode and the gate of the driving transistor is initialized.

Preferably, the threshold voltage compensating step comprises: controlling the first transistor, the third transistor, and the sixth transistor to be turned on, and controlling the second transistor, the fourth transistor, and the fifth transistor to be turned off, such that the first capacitor is charged by the reference voltage via the driving unit until the driving unit is automatically turned off.

Preferably, the pixel driving display step comprises: controlling the second transistor, the fourth transistor, and the fifth transistor to be turned on, and controlling the first transistor, the third transistor, and the sixth transistor to be turned off, such that a constant driving current independent of the threshold voltage of the driving unit is provided to the light emitting unit by the light emitting control unit.

Preferably, the method further comprises a preparing step before the initialization step, the preparing step comprising: controlling the fifth transistor to be turned on, and controlling the first transistor, the second transistor, the third transistor, the fourth transistor, and the sixth transistor to be turned off, to prepare for writing the data voltage into the first capacitor.

Preferably, the method further comprises a buffering step before the pixel driving display step, the buffering step comprises: controlling the first transistor, the second transistor, the third transistor, the fourth transistor, the fifth transistor, and the sixth transistor to be turned off.

According to the present disclosure, by inputting the reference voltage into the source of the driving transistor and by utilizing the driving transistor in a form of diode to write the threshold voltage of the driving transistor into the capacitor, the pixel driving circuit has a driving display function which is able to compensate the threshold voltage of the driving transistor. That is, by writing the threshold voltage into the capacitor via a diode in a saturated state to provide a gate-source voltage of the driving transistor, the driving current of the driving transistor is independent of the threshold voltage of the driving transistor, thereby improving the uniformity of the luminance and reliability of the display panel.

BRIEF DESCRIPTION OF THE DRAWINGS

The above and other aspects, features, and advantages of various embodiments of the present disclosure will be more apparent from the following detailed description taken in conjunction with the accompanying drawings, in which.

DETAILED DESCRIPTION

To make those skilled in the art understand the solutions of the present disclosure in a better manner, a detailed description will be given in conjunction with the drawings and specific embodiments.

Figure 1:
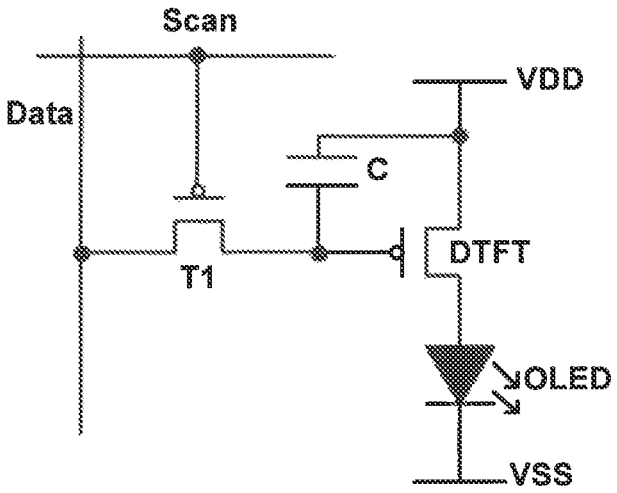
FIG. 1 CONVENTIONAL ART
FIG. 1 is a block diagram of an existing 2T1C circuit.
Figure 2:
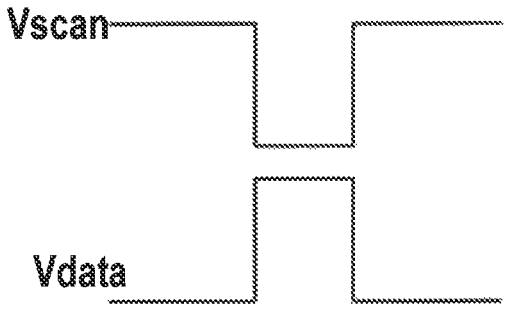
FIG. 2 CONVENTIONAL ART
FIG. 2 is an operation timing diagram of the 2T1C circuit of FIG. 1.
Figure 3:
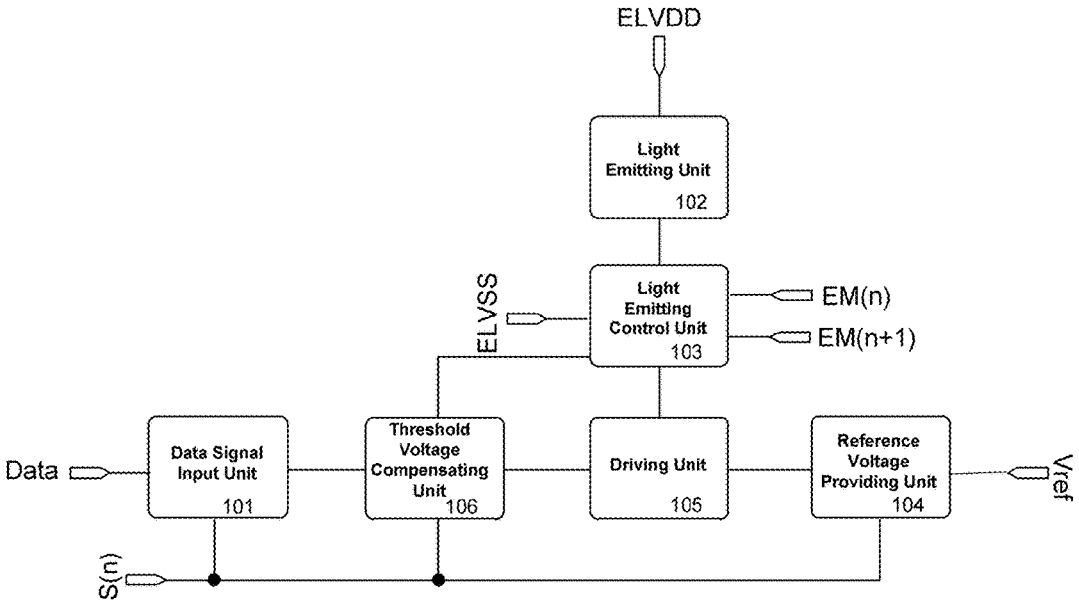
FIG. 3 is a block diagram showing a structure of a pixel driving circuit according to an embodiment of the present disclosure.

Referring to FIG. 3, it is a block diagram showing a structure of a pixel driving circuit 100 according to an embodiment of the present disclosure. The pixel driving circuit 100 comprises: a data signal input unit 101, a light emitting unit 102, a light emitting control unit 103, a reference voltage providing unit 104, a driving unit 105, and a threshold voltage compensating unit 106.

The data signal input unit 101 is connected to a data signal terminal Data, a first control signal terminal S(n), and a threshold voltage compensating unit 106, respectively, for receiving data signals and providing the threshold voltage compensating unit 106 with a data voltage Vdata.

The light emitting unit 102 is connected to the light emitting control unit 103 and a high voltage terminal ELVDD, respectively, and it comprises an organic light emitting diode (OLED) for emitting lights and displaying.

The light emitting control unit 103 is connected to the light emitting unit 102, the driving unit 105, the threshold voltage compensating unit 106, a second control signal terminal EM(n), a third control signal terminal EM(n+1), and a low voltage terminal ELVSS, respectively, for controlling light emission of the light emitting unit 102 at the pixel driving display phase.

The reference voltage providing unit 104 is connected to a reference voltage terminal ref, the driving unit 105, and the first control signal terminal S(n), respectively, for receiving the reference voltage Vref and providing the driving unit 105 with the same.

The driving unit 105 is connected to the reference voltage providing unit 104, the light emitting control unit 103, and the threshold voltage compensating unit 106, respectively, for receiving the reference voltage Vref provided by the reference voltage providing unit 104, and providing the light emitting unit 102 via the light emitting control unit 103 with the driving current independent of the threshold voltage Vth of the driving unit 105 at the pixel driving display phase, thereby driving the light emitting unit to emit lights.

The threshold voltage compensating unit 106 is connected to the data signal input unit 101, the driving unit 105, the light emitting control unit 103, and the first control signal terminal S(n), respectively, for receiving the data voltage Vdata via the data signal input unit 101 at the initialization phase, and storing the data voltage and the threshold voltage of the driving unit 105 at the threshold voltage compensating phase. In this way, the voltage provided to the driving unit 105 at the pixel driving display phase is able to compensate the threshold voltage Vth of the driving unit 105.

Preferably, the voltage output at the high voltage terminal ELVDD is greater than the voltage output at the low voltage terminal ELVSS.

The pixel driving circuit provided by the present embodiment has a driving display function which may compensate the threshold voltage of the driving transistor. The voltage provided to the gate of the driving unit 105 by the threshold voltage compensating unit 106 in this pixel driving circuit at the threshold voltage compensating phase is able to compensate the threshold voltage Vth of the driving unit 105, and the driving unit 105 provides the light emitting control unit 102 with the driving current independent of the threshold voltage Vth of the driving unit 105 at the pixel driving display phase. The consistency of the driving current for the display panel is achieved and therefore the luminance uniformity and reliability of the display panel are improved.

Figure 4:
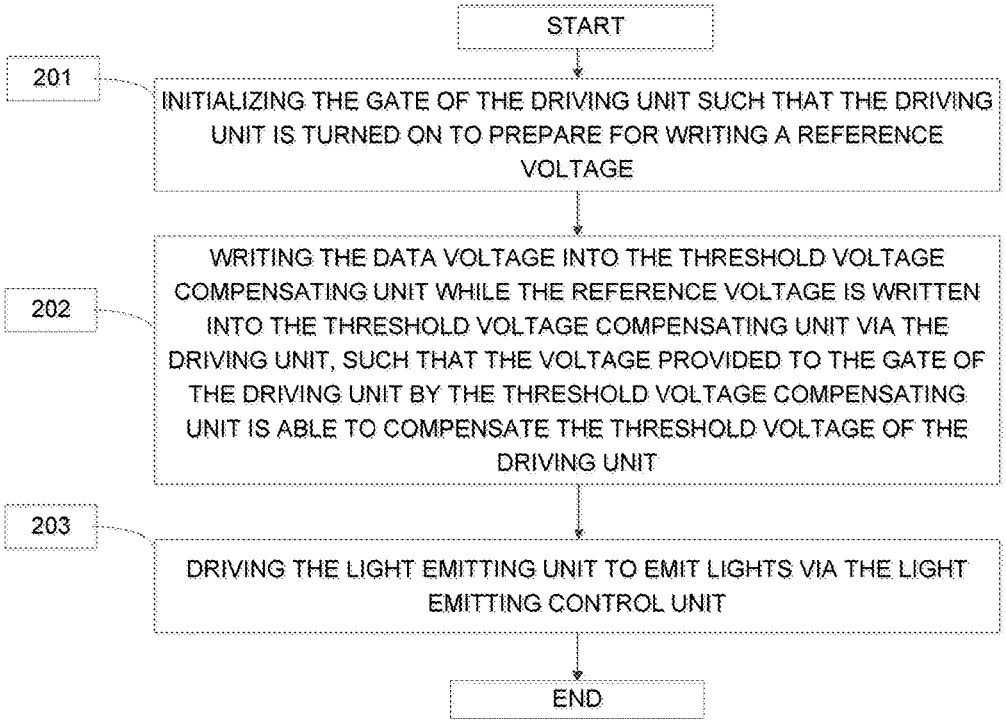
FIG. 4 is a flow chart showing a method for driving a pixel driving circuit according to an embodiment of the present disclosure.

Referring to FIG. 4, it is a flow chart showing a method for driving a pixel driving circuit 100 according to an embodiment of the present disclosure, the driving method comprising steps of:

an initialization step 201 of initializing the gate of the driving unit 105 such that the driving unit 105 is turned on to prepare for writing a reference voltage Vref;

a threshold voltage compensating step 202 of writing the data voltage Vdata into the threshold voltage compensating unit 106 while the reference voltage Vref is written into the threshold voltage compensating unit 106 via the driving unit 105, such that the voltage provided to the gate of the driving unit 105 by the threshold voltage compensating unit 106 is able to compensate the threshold voltage of the driving unit 105; and a pixel driving display step 203 of driving the light emitting unit 102 to emit lights via the light emitting control unit 103.

During the threshold voltage compensating step 202, the data voltage Vdata is written into the threshold voltage compensating unit 106, while the threshold voltage Vth of the driving unit 105 and the reference voltage Vref received from the reference voltage providing unit 104 by the driving unit 105 are also written into the threshold voltage compensating unit 106, until the driving unit 105 is automatically turned off. In this way, after the data writing is completed, the threshold voltage compensating unit 106 may provide the driving unit 105 with a voltage (that is, the gate-source voltage of the driving unit 105): Vdata−(Vref−|Vth|). Therefore, during the pixel driving display step 203, the driving unit 105 provides the light emitting control unit 103 with a driving current independent of the threshold voltage Vth of the driving unit 105. Thus, the consistency of the driving current of the display panel is maintained and the luminance uniformity and reliability of the display panel are improved.

During the pixel driving display step 203, the light emitting control unit 103 is turned on to interconnect the driving unit 105 and the light emitting unit 102, and the driving unit 105 provides the light emitting unit 102 with a constant light emitting current.

Figure 5:
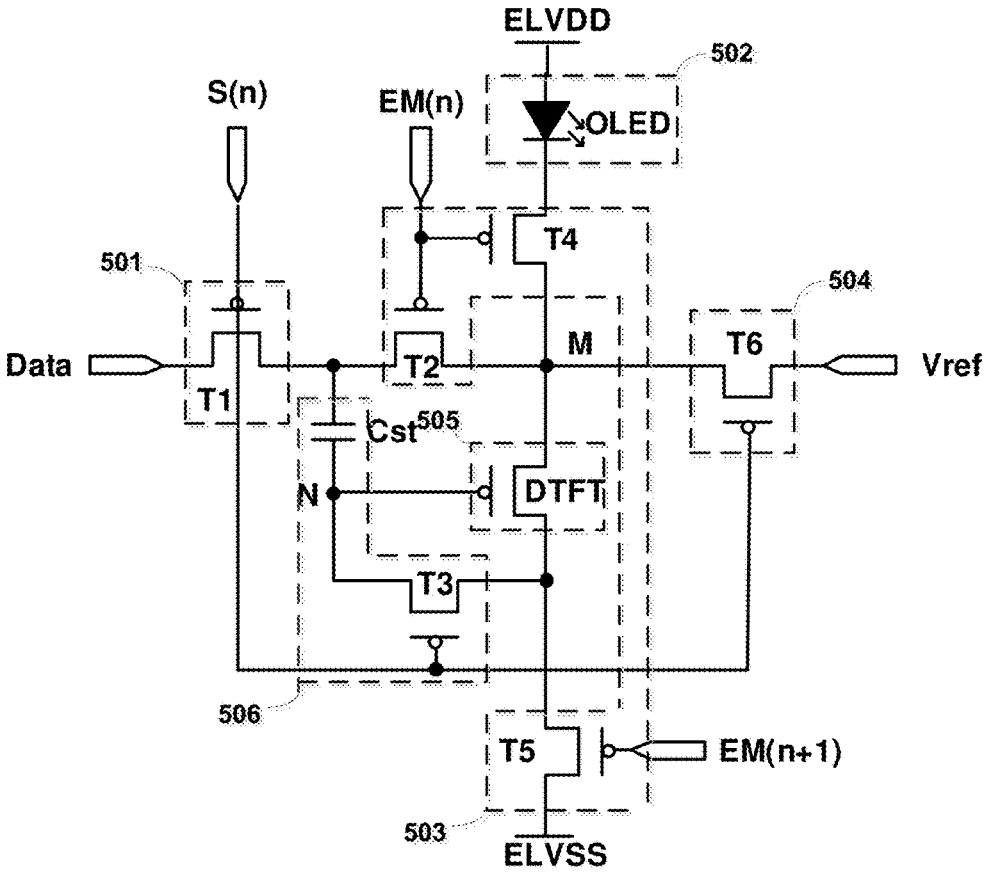
FIG. 5 is a block diagram showing a structure of a pixel driving circuit according to another embodiment of the present disclosure.

Referring to FIG. 5, it is a block diagram showing a structure of a pixel driving circuit 500 according to another embodiment of the present disclosure. The pixel driving circuit 500 comprises: a data signal input unit 501, a light emitting unit 502, a light emitting control unit 503, a reference voltage providing unit 504, a driving unit 505, and a threshold voltage compensating unit 506.

The data signal input unit 501 is configured to receive a data signal and provide the threshold voltage compensating unit 506 with a data voltage Vdata.

The light emitting unit 502 is configured to emit lights and display.

The light emitting control unit 503 is configured to control the light emission of the light emitting unit 502 at the pixel driving display phase.

The reference voltage providing unit 504 is configured to receive a reference voltage Vref and provide the driving unit 505 with the same.

The driving unit 505 is configured to receive the reference voltage Vref provided by the reference voltage providing unit 504, and to provide the light emitting control unit 502 with a driving current which is not affected by the threshold voltage Vth of the driving unit 505 at the pixel driving display phase.

The threshold voltage compensating unit 506 receives the data voltage Vdata provided by the data signal input unit 501, and is configured to store the data voltage and the threshold voltage of the driving unit 505 at the threshold voltage compensating phase.

The detailed description of structures of the above various units will be given below.

The data signal input unit 501 comprises a first transistor T1. The light emitting unit 502 comprises an organic light emitting diode (OLED) for emitting lights. The light emitting control unit 503 comprises a second transistor T2, a fourth transistor T4, and a fifth transistor T5. The reference voltage providing unit 504 comprises a sixth transistor T6. The driving unit 505 comprises a driving transistor DTFT. The threshold voltage compensating unit 506 comprises a first capacitor Cst and a third transistor T3.

The organic light emitting diode has a first electrode connected to a second electrode of the fourth transistor T4 and a second electrode connected to the high voltage terminal ELVDD.

The first transistor T1 has a gate connected to the first control signal terminal S(n), a first electrode connected to the data signal terminal, and a second electrode connected to a first terminal of the first capacitor Cst.

The driving transistor DTFT has a gate connected to a second terminal of the first capacitor Cst, a first electrode connected to a first electrode of the fifth transistor T5, and a second electrode connected to a second electrode of the sixth transistor T6.

The second transistor T2 has a gate connected to the second control signal terminal EM(n), a first electrode connected to the first terminal of the first capacitor Cst, and a second electrode connected to the second electrode of the driving transistor DTFT.

The fourth transistor T4 has a gate connected to the second control signal terminal EM(n), a first electrode connected to the second electrode of the driving transistor DTFT, and a second electrode connected to a first electrode of the organic light emitting diode.

The fifth transistor T5 has a gate connected to a third control signal terminal EM(n+1), a first electrode connected to the first electrode of the driving transistor DTFT, and a second electrode connected to the low voltage terminal ELVSS.

The first capacitor Cst has a first terminal connected to the second electrode of the first transistor T1 and a second terminal connected to the gate of the driving transistor DTFT.

The third transistor T3 has a gate connected to the first control signal terminal S(n), a first electrode connected to the first electrode of the driving transistor DTFT, and a second electrode connected to the second terminal of the first capacitor Cst.

The sixth transistor T6 has a gate connected to the first control signal terminal S(n), a first electrode connected to the reference voltage terminal ref, and a second electrode connected to the second electrode of the driving transistor DTFT.

In this embodiment, the pixel driving circuit 500 is constituted of seven thin film transistors and one storage capacitor, and all of the seven thin film transistors may be N-type thin film transistors, P-type thin film transistors, or any combination thereof. In this embodiment, as an example, the seven thin film transistors in the pixel driving circuit 500 are all P-type thin film transistors wherein T1-T6 are switching transistors and DTFT is a driving thin film transistor, wherein all of ELVDD, ELVSS, and ref output three DC levels, and wherein the voltage output at the high voltage terminal ELVDD is greater than the voltage output at the low voltage terminal ELVSS. Therefore, when the control signal is at a high level, the switching thin film transistor is turned off, and when the control signal is at a low level, the switching thin film transistor is turned on. Preferably, the first electrodes of T1-T6 may be sources and the second electrodes of T1-T6 may be drains; however the first electrodes of T1-T6 may also be drains and the second electrodes of T1-T6 may also be sources.

In this embodiment, under the control of the first control signal from the first control signal terminal S(n), the reference voltage providing unit 504 provides the source of the driving transistor DTFT with the reference voltage Vref directly, while the data signal input unit 501 writes the data voltage Vdata into the first capacitor Cst directly. Therefore, the first capacitor Cst is charged continuously by the reference voltage Vref via the driving transistor DTFT, and the electric potential at point N is increasing until it becomes to Vref−|Vth|. At this time, the driving transistor DTFT is turned off while the writing of the data voltage Vdata is completed, and therefore the voltage across the first capacitor Cst is Vcst=Vdata−(Vref−|Vth|). In this way, the pixel driving circuit has a function that is able to compensate the threshold voltage Vth of the driving transistor DTFT. That is, the threshold voltage Vth is written into the first capacitor Cst by the driving transistor connected in a form of diode, such that the threshold voltage of the driving transistor is compensated and the driving current is independent of the threshold voltage of the driving transistor, thereby improving the luminance uniformity and reliability of the display panel.

Figure 6:
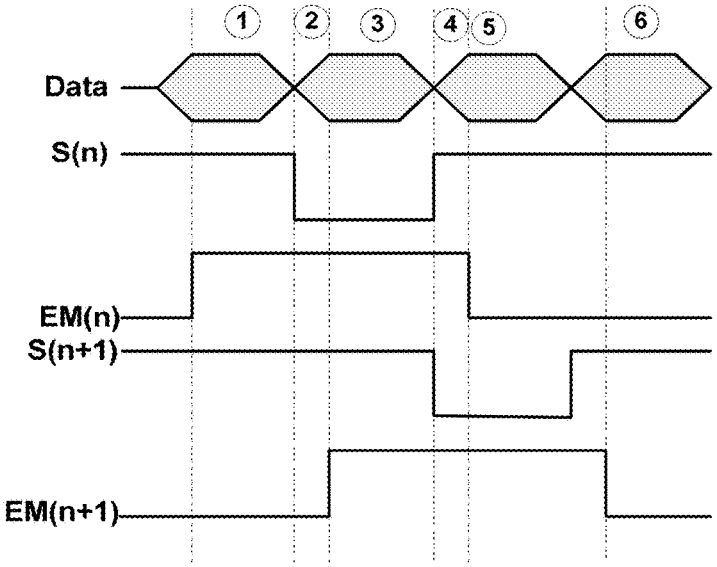
FIG. 6 is a timing diagram of a pixel driving circuit according to another embodiment of the present disclosure.

Hereinafter, a detailed description of the operations of a pixel driving circuit according to another exemplary embodiment of the present disclosure is given with reference to FIG. 5, FIG. 6, and FIGS. 7*a*-7*f*. FIG. 6 is a timing diagram of a pixel driving circuit 500 according to another embodiment of the present disclosure; and FIGS. 7A-7*f* are equivalent circuit diagrams at various phases in the timing diagram of FIG. 6.

Referring to FIG. 6, the operations of the pixel driving circuit 500 are divided into six phases, that is, ① a preparing phase, ② an initialization phase, ③ a threshold voltage compensating phase, ④ a first buffering phase, ⑤ a second buffering phase, and ⑥ a pixel driving display phase.

Figure 7A:
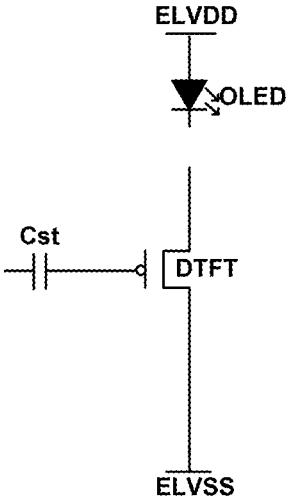
FIG. 7*a*-FIG. 7*f* are equivalent circuit diagrams at various phases in the timing diagram of FIG. 6.

In the preparing phase, it is prepared for writing the data voltage Vdata into the first capacitor Cst. To be specific, the first control signal S(n) and the second control signal EM(n) are set as high levels and the third control signal EM(n+1) is set as a low level, thereby the transistor T5 being turned on and the transistors T1, T2, T3, T4, and T6 being turned off. Since the transistor T4 is in an off state, the organic light emitting diode (OLED) is in a non-operating state. The equivalent circuit diagram at the preparing phase is shown in FIG. 7*a*.

Figure 7B:
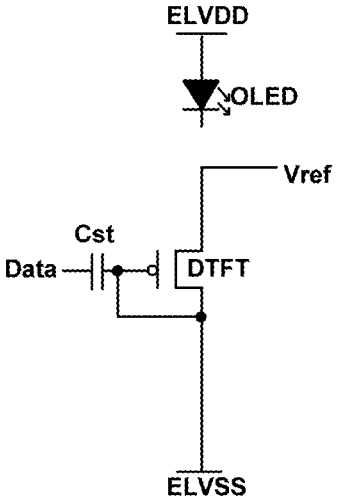

At the initialization phase, the reference voltage Vref is provided to the driving transistor while the data voltage Vdata is begun to be written into the first capacitor Cst. To be specific, during this phase, the second control signal EM(n) is set as a high level, and the first control signal S(n) and the third control signal EM(n+1) are set as low levels. In this way, the transistors T1, T3, T5, and T6 are turned on, and the transistors T2 and T4 are turned off. The reference voltage Vref is fed in at the point M, and since the transistor T3 is turned on and the driving transistor DTFT is connected and turned on as a diode, the electric potential at the point N is initialized as a lower level while the data voltage Vdata is written into the first capacitor Cst. The equivalent circuit diagram at the initialization phase is shown in FIG. 7*b*.

Figure 7C:
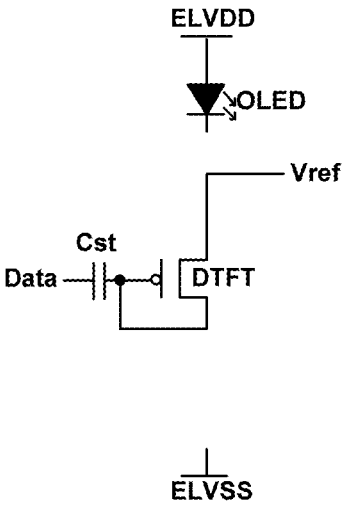

At the threshold voltage compensating phase, the second control signal EM(n) and the third control signal EM(n+1) are set as high levels, and the first control signal S(n) is set as a low level. In this way, the transistors T1, T3, and T6 are turned on, and the transistors T2, T4, and T5 are turned off. The data voltage Vdata is kept being written into the first capacitor Cst, while the threshold voltage Vth of the driving transistor DTFT is also written into the first capacitor Cst. Since the transistor T3 is turned on, the DTFT is still connected as a diode; since the electric potential at the point N is initialized to a lower level at the initialization phase, the first capacitor Cst is charged continuously by the reference voltage Vref via the driving transistor DTFT and the electric potential at the point N is increasing until it becomes Vref−|Vth|. At this time, the driving transistor DTFT is turned off while the writing of the data voltage Vdata is also completed, and therefore the voltage across the storage capacitor Cst is Vcst=Vdata−(Vref−|Vth|). The equivalent circuit diagram at the threshold voltage compensating phase is shown in FIG. 7*c*.

Figure 7D:
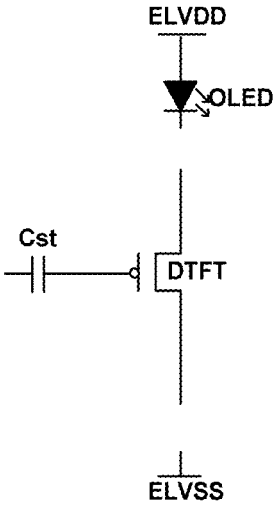

At the first buffering phase, the first control signal S(n), the second control signal EM(n), and the third control signal EM(n+1) are set as high levels, and therefore the transistors T1, T2, T3, T4, T5, and T6 are turned off. All writing of the signals is completed at this phase for buffering the signals to avoid unnecessary noise due to simultaneous switching of the switching signals. The equivalent circuit diagram at the first buffering phase is shown in FIG. 7*d*.

Figure 7E:
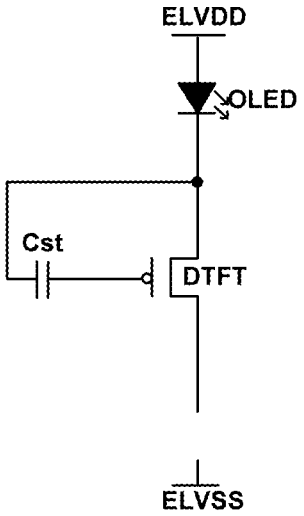

At the second buffering phase, the first control signal S(n) and the third control signal EM(n+1) are set as high levels and the second control signal EM(n) is set as a low level, and therefore the transistors T2 and T4 are turned on and the transistors T1, T3, T5, and T6 are turned off. This phase is still a buffering phase for avoiding any unnecessary noise caused by the simultaneous switching of the switching signals. The equivalent circuit diagram at the second buffering phase is shown in FIG. 7*e*.

At the pixel driving display phase, the light emitting control unit 502 is driven to control the light emission and display of the light emitting unit 501. To be specific, during this phase, the first control signal S(n) is set as a high level, and the second control signal EM(n) and the third control signal EM(n+1) is set as a low level. In this way, the transistors T2, T4, and T5 are turned on, and the transistors T1, T3, and T6 are turned off. At this phase, the gate-source voltage of the driving transistor DTFT is the voltage across the first capacitor Cst, and therefore the gate-source voltage of the DTFT is Vsg=Vcst=Vdata−(Vref-|Vth|). The light emitting current flowing through the organic light emitting diode OLED is determined by the gate-source voltage Vsg of the driving transistor DTFT, and the light emitting current is given by the following equation.

$$I_{oled} = K(Vsg - |Vth|)^2 = K[Vdata - (Vref - |Vth|) - |Vth|]^2$$
$$= K(Vdata - Vref)^2$$

Figure 7F:
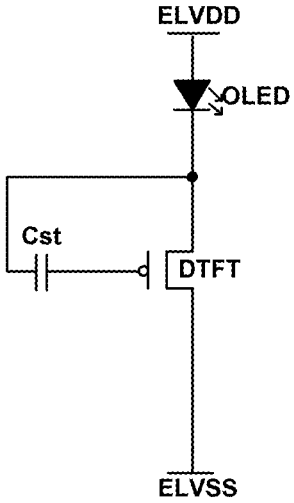

From the above equation, the light emitting current of the OLED is only related to the reference voltage Vref and the data voltage Vdata, and is independent of the threshold voltage Vth of the driving transistor, where K is a constant related to the process and design, and since Vdata is greater than or equal to Vref, the minimum value of $I_{oled}$ is 0 which represents 0 grey-scale. The equivalent circuit diagram at the pixel driving display phase is shown in FIG. 7*f*.

The operating method of this embodiment eliminates the impact of the threshold voltage Vth of the driving transistor DTFT, such that the driving current of the driving transistor is independent of the threshold voltage of the driving transistor, thereby achieving the consistency of the driving current. The luminance uniformity and the reliability of the display panel are thus improved.

Obviously, various changes and modifications can be made to the embodiments of the present disclosure by those skilled in the art without departing the spirit and scope of the present disclosure. The scope of the disclosure is defined by the appended claims and their equivalents.

We claim:

1. A pixel driving circuit, comprising:

a data signal input unit configured to receive a data signal and provide a data voltage;

a light emitting unit configured to emit light and display;

a light emitting control unit configured to control the light emission of the light emitting unit at a pixel driving display phase;

a reference voltage providing unit configured to provide a reference voltage;

a driving unit configured to receive the reference voltage provided by the reference voltage providing unit and drive the light emitting unit via the light emitting control unit at the pixel driving display phase; and a threshold voltage compensating unit configured to receive the data voltage via the data signal input unit at the initialization phase, and store the data voltage and the threshold voltage of the driving unit at the threshold voltage compensating phase, such that the voltage provided to the gate of the driving unit at the pixel driving display phase is able to compensate the threshold voltage of the driving unit and the driving current of the driving unit is controlled accurately, wherein the data signal input unit is connected to a data signal terminal, a first control signal terminal, and the threshold voltage compensating unit, wherein the light emitting unit is connected to the light emitting control unit and a high voltage terminal, wherein the light emitting control unit is connected to the light emitting unit, the driving unit, the threshold voltage compensating unit, a second control signal terminal, a third control signal terminal, and a low voltage terminal, wherein the reference voltage providing unit is connected to the driving unit, a reference voltage terminal, and the first control signal terminal, wherein the driving unit is connected to the light emitting control unit, the reference voltage providing unit, and the threshold voltage compensating unit, and wherein the threshold voltage compensating unit is connected to the data signal input unit, the light emitting control unit, the driving unit, and the first control signal terminal, and wherein the reference voltage providing unit provides, under the control of the first control signal, a driving transistor with the reference voltage, such that, when the driving transistor is connected in a form of diode, a gate of the driving transistor is charged by the reference voltage via the driving transistor such that a voltage at the gate of the driving transistor is equal to the difference between the reference voltage and a threshold voltage of the driving transistor.

2. The pixel driving circuit according to claim 1, wherein the light emitting unit comprises an organic light emitting diode for emitting lights, the organic light emitting diode having a first electrode connected to the light emitting control unit and a second electrode connected to the high voltage terminal.

3. The pixel driving circuit according to claim 2, wherein the data signal input unit comprises a first transistor, wherein the first transistor has a gate connected to the first control signal terminal, a first electrode connected to the data signal terminal, and a second electrode connected to the threshold voltage compensating unit.

4. The pixel driving circuit according to claim 3, wherein the driving unit comprises the driving transistor, wherein the gate of the driving transistor is connected to the threshold voltage compensating unit, a first electrode of the driving transistor is connected to the light emitting control unit, and a second electrode of the driving transistor is connected to the reference voltage providing unit, and the driving transistor is configured to provide the light emitting unit via the light emitting control unit with a constant driving current independent of the threshold voltage.

5. The pixel driving circuit according to claim 4, wherein the light emitting control unit comprises a second transistor, a fourth transistor, and a fifth transistor, wherein the second transistor has a gate connected to the second control signal terminal, a first electrode connected to the second electrode of the first transistor, and a second electrode connected to the second electrode of the driving transistor, wherein the fourth transistor has a gate connected to the second control signal terminal, a first electrode connected to the second electrode of the driving transistor, and a second electrode connected to the light emitting unit, and wherein the fifth transistor has a gate connected to the third control signal terminal, a first electrode connected to the first electrode of the driving transistor, and a second electrode connected to the low voltage terminal.

6. The pixel driving circuit according to claim 5, wherein the threshold voltage compensating unit comprises a first capacitor and a third transistor, wherein the first capacitor has a first terminal connected to the second electrode of the first transistor and a second terminal connected to the gate of the driving transistor, and wherein the third transistor has a gate connected to the first control signal terminal, a first electrode connected to the first electrode of the driving transistor, and a second electrode connected to the second terminal of the first capacitor.

7. The pixel driving circuit according to claim 6, wherein the reference voltage providing unit comprises a sixth transistor, wherein the sixth transistor has a gate connected to the first control signal terminal, a first electrode connected to a reference voltage terminal, and a second electrode connected to the second electrode of the driving transistor.

8. The pixel driving circuit according to claim 7, wherein the data signal input unit writes the data voltage into the first capacitor under the control of the first control signal, such that the voltage across the first capacitor is equal to the data voltage minus the difference between the reference voltage and the threshold voltage of the driving transistor.

9. The pixel driving circuit according to claim 8, wherein the first transistor, the second transistor, the third transistor, the fourth transistor, the fifth transistor, the sixth transistor, and the driving transistor are P-type thin film transistors or N-type thin film transistors.

10. A method for driving a pixel driving circuit according to claim 1, the method comprising:

an initialization step of initializing a gate of the driving unit to prepare for writing a reference voltage;

a threshold voltage compensating step of writing a data voltage into the threshold voltage compensating unit while a reference voltage is written into the threshold voltage compensating unit via the driving unit, such that the voltage provided by the threshold voltage compensating unit to the gate of the driving unit is able to compensate the threshold voltage of the driving unit and the driving current of the driving unit is controlled accurately; and a pixel driving display step of driving, via the light emitting control unit, the light emitting unit to emit light.

11. A method for driving a pixel driving circuit according to claim 7, the method comprising:

an initialization step of initializing a gate of the driving unit to prepare for writing a reference voltage;

a threshold voltage compensating step of writing a data voltage into the threshold voltage compensating unit while a reference voltage is written into the threshold voltage compensating unit via the driving unit, such that the voltage provided by the threshold voltage compensating unit to the gate of the driving unit is able to compensate the threshold voltage of the driving unit and the driving current of the driving unit is controlled accurately; and a pixel driving display step of driving, via the light emitting control unit, the light emitting unit to emit light;

wherein the initialization step comprises: controlling the first transistor, the third transistor, the fifth transistor, and the sixth transistor to be turned on, and controlling the second transistor and the fourth transistor to be turned off, such that the driving transistor is connected in a form of diode and the gate of the driving transistor is initialized.

12. The method for driving according to claim 11, wherein the threshold voltage compensating step comprises: controlling the first transistor, the third transistor, and the sixth transistor to be turned on, and controlling the second transistor, the fourth transistor, and the fifth transistor to be turned off, such that the first capacitor is charged by the reference voltage via the driving unit until the driving unit is automatically turned off.

13. The method for driving according to claim 12, wherein the pixel driving display step comprises: controlling the second transistor, the fourth transistor, and the fifth transistor to be turned on, and controlling the first transistor, the third transistor, and the sixth transistor to be turned off, such that a constant driving current independent of the threshold voltage of the driving unit is provided to the light emitting unit by the light emitting control unit.

14. The method for driving according to claim 13, wherein the method further comprises a preparing step before the initialization step, the preparing step comprising: controlling the fifth transistor to be turned on, and controlling the first transistor, the second transistor, the third transistor, the fourth transistor, and the sixth transistor to be turned off, to prepare for writing the data voltage into the first capacitor.

15. The method for driving according to claim 14, wherein the method further comprises a buffering step before the pixel driving display step, the buffering step comprises: controlling the first transistor, the second transistor, the third transistor, the fourth transistor, the fifth transistor, and the sixth transistor to be turned off.

16. The method for driving according to claim 10, wherein the data signal input unit comprises a first transistor, wherein the first transistor has a gate connected to the first control signal terminal, a first electrode connected to the data signal terminal, and a second electrode connected to the threshold voltage compensating unit.

17. The method for driving according to claim 16, wherein the driving unit comprises the driving transistor, wherein the gate of the driving transistor is connected to the threshold voltage compensating unit, a first electrode of the driving transistor is connected to the light emitting control unit, and a second electrode of the driving transistor is connected to the reference voltage providing unit, and the driving transistor is configured to provide the light emitting unit via the light emitting control unit with a constant driving current independent of the threshold voltage.

18. The method for driving according to claim 17, wherein the light emitting control unit comprises a second transistor, a fourth transistor, and a fifth transistor, wherein the second transistor has a gate connected to the second control signal terminal, a first electrode connected to the second electrode of the first transistor, and a second electrode connected to the second electrode of the driving transistor, wherein the fourth transistor has a gate connected to the second control signal terminal, a first electrode connected to the second electrode of the driving transistor, and a second electrode connected to the light emitting unit, and wherein the fifth transistor has a gate connected to the third control signal terminal, a first electrode connected to the first electrode of the driving transistor, and a second electrode connected to the low voltage terminal.

19. The method for driving according to claim 18, wherein the threshold voltage compensating unit comprises a first capacitor and a third transistor, wherein the first capacitor has a first terminal connected to the second electrode of the first transistor and a second terminal connected to the gate of the driving transistor, and wherein the third transistor has a gate connected to the first control signal terminal, a first electrode connected to the first electrode of the driving transistor, and a second electrode connected to the second terminal of the first capacitor.

20. The method for driving according to claim 19, wherein the reference voltage providing unit comprises a sixth transistor, wherein the sixth transistor has a gate connected to the first control signal terminal, a first electrode connected to a reference voltage terminal, and a second electrode connected to the second electrode of the driving transistor.

* * * * *